United States Patent [19]

Kanto et al.

[11] Patent Number: 5,021,394

[45] Date of Patent: Jun. 4, 1991

[54] HEAT TRANSFER SHEET

[75] Inventors: Jumpei Kanto; Hitoshi Saito; Hiroshi Eguchi; Masayuki Nakamura, all of Tokyo, Japan

[73] Assignee: Dai Nippon Insatsu Kabushiki Kaisha, Tokyo, Japan

[21] Appl. No.: 537,929

[22] Filed: Jun. 13, 1990

[30] Foreign Application Priority Data

Jun. 15, 1989 [JP] Japan ..... 1-150416
Jun. 15, 1989 [JP] Japan ..... 1-184984

[51] Int. Cl.[5] ..... B41M 5/035; B41M 5/26

[52] U.S. Cl. ..... 503/227; 8/471; 428/195; 428/913; 428/914

[58] Field of Search ..... 8/471; 428/195, 913, 428/914; 503/227

[56] References Cited

FOREIGN PATENT DOCUMENTS 2050187 3/1987 Japan ..... 503/227

*Primary Examiner*—Bruce H. Hess
*Attorney, Agent, or Firm*—Parkhurst, Wendel & Rossi

[57] ABSTRACT

A heat transfer sheet including a substrate sheet and a dye carrying layer formed on the substrate sheet, with a dye included in the dye carrying layer being expressed by the following general formula (I) or (II):

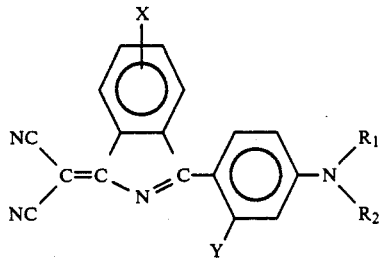

(I)

wherein:

X stands for a hydrogen atom or at least one substituent,

Y indicates a hydrogen atom, a hydroxyl group, an alkyl group, an alkoxy group, —OCOR′, —NHCOR′ or —$NHSO_2R'$ in which R′ stands for an alkyl group or a substituted alkyl group, and $R_1$ and $R_2$ each denote an alkyl group or a substituted alkyl group, or

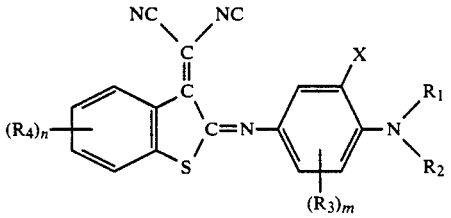

(II)

wherein:

$R_1$ stands for a substituted or unsubstituted alkyl, cycloalkyl, aralkyl or aryl group, or an atom or atomic group which forms a five- or six-membered ring with X, $R_2$ denotes a substituted or unsubstituted alkyl, cycloalkyl, aralkyl or aryl group, said $R_1$ and $R_2$ may form together a five- or six-membered ring which may include an oxygen or nitrogen atom, $R_3$ and $R_4$ each represent a hydrogen atom, a halogen atom, a cyano group or a nitro group, or an alkyl, cycloalkyl, alkoxy, aryl, aralkyl, acylamino, sulfonylamino, ureido, carbamoyl, sulfamoyl, acyl or amino group which may contain a substituent, X stands for a hydrogen atom, or an atom or atomic group which form a five- or six-membered ring with $R_1$, and m and n each are 1 or 2.

4 Claims, No Drawings

HEAT TRANSFER SHEET

BACKGROUND OF THE INVENTION

The present invention relates to a heat transfer sheet and, more particularly, seeks to provide a heat transfer sheet capable of making a recorded image excelling in density of developed colors, definition and various fastness properties, and in particular, storability and resistance to discoloration/fading.

Heretofore, various heat transfer techniques have been known in the art, including sublimation type transfer systems wherein a sublimable dye is carried on a substrate sheet such as paper to make a heat transfer sheet, which is then overlaid on an imageable material dyeable with a sublimable dye, for instance, a woven fabric made of polyester, to apply heat energy in the form of a pattern from the back side of the heat transfer sheet, thereby transferring the sublimable dye to the imageable material.

More recently, there have been proposed techniques for making various full-color images on paper or plastic films with the above sublimation type of heat transfer systems in which thermal heads of printers are used as heating means to transfer three-, four- or more-color dots to image-receiving sheets by heating for a very short-time, thereby reproducing full-color images of manuscripts with the multicolor dots.

Because the coloring materials used are dyes, the images thus formed are very clear and because of their excellent transparency, the obtained images are improved in reproducibility and gradation of neutral tints, are equivalent to those achieved by conventional offset or gravure printing, and are comparable in quality to full-color photographic images.

However the most important problems with the above heat transfer systems are the density of the developed colors, and the storability and resistance to discoloration/fading of the formed images.

In fast recording, heat energy is required to be applied within a time as short as a fraction of a second. However, no image of sufficient density can be obtained since sublimable dyes and image-receiving sheets are not well heated within such a short time.

In order to cope with such high-speed recording, sublimable dyes excelling in sublimability have been developed. However, problems with such dyes of excellent sublimability are that after transfer, they pass into the imageable materials or bleed onto their surfaces with time, generally because of their low molecular weight. As a consequence, the images, once formed, become diffused or blurred, or otherwise contaminate surrounding articles.

Even when a sublimable dye having a relatively high molecular weight is used to avoid such problems, an image of satisfactory density cannot be obtained since its rate of sublimation is too slow for such fast recording as mentioned above.

Generally, the obtained images are inferior in light resistance to those obtained with pigments, because of being formed of dyes, and therefore posing problems that premature fading or discoloration takes place upon direct exposure to sunlight. Such light resistance problems may be solved to some extent by adding UV absorbers or antioxidants to the dye-receiving layers of image-receiving sheets.

However, discoloration/fading problems are also caused for other reasons, for instance, when the images are exposed to indoor light or even while they are slipped in albums or encased in cases or form parts of books, all protected against the direct rays of the sun. Such discoloration/fading problems occurring indoors and in dark places can never be solved by using generally available UV absorbers or antioxidants.

A main object of the present invention is therefore to provide a heat transfer sheet which can be applied to a heat transfer process using a sublimable dye to make a clear image which is not only of sufficient density but which also excels in various fastness properties, esp., storability and resistance to discoloration/fading.

SUMMARY OF THE INVENTION

The above object is attained by the present invention to be herein described in greater detail.

According to one aspect of the present invention, there is provided a heat transfer sheet comprising a substrate sheet and a dye-carrying layer formed on the substrate sheet, characterized in that a dye included in said dye carrying layer is expressed by the following general formula (I):

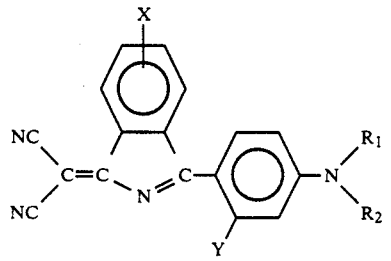

(I)

wherein:

X stands for a hydrogen atom or at least one substituent,

Y indicates a hydrogen atom, a hydroxyl group, an alkyl group, an alkoxy group, —OCOR′, —NHCOR′ or —$NHSO_2R'$ in which R′ stands for an alkyl group or a substituted alkyl group, and $R_1$ and $R_2$ each denote an alkyl group or a substituted alkyl group.

According to another aspect of the present invention, there is provided a heat transfer sheet comprising a substrate sheet and a dye carrying layer formed on its one major side, characterized in that a dye included in said dye carrying layer is expressed by the following general formula (II):

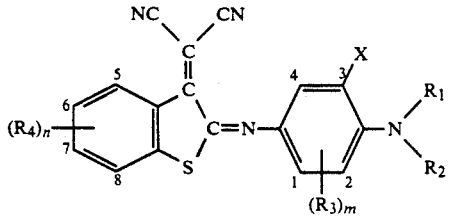

(II)

wherein:

$R_1$ stands for a substituted or unsubstituted alkyl, cycloalkyl, aralkyl or aryl group, or an atom or atomic group which forms a five- or six-membered ring with X, $R_2$ denotes a substituted or unsubstituted alkyl, cycloalkyl, aralkyl or aryl group, said $R_1$ and $R_2$ may form together a five- or six-membered ring which may include an oxygen or nitrogen atom, $R_3$ and $R_4$ each represent a hydrogen atom, a halogen atom, a cyano group or a nitro group, or an alkyl, cycloalkyl, alkoxy, aryl, aralkyl, acylamino, sulfonylamino, ureido, carbamoyl, sulfamoyl, acyl or amino group which may contain a substituent, X stands for a hydrogen atom, or an atom or atomic group which forms a five- or six-membered ring with $R_1$, and m and n each are 1 or 2.

The present invention provides heat transfer sheets in which the dyes of such structures as specified above are allowed to pass easily into image-receiving sheets even by a very short-time exposure to heat energy, thereby giving recorded images which possess high density and various satisfactory fastness properties such as storability and resistance to discoloration/fading in particular.

DETAILED DESCRIPTION OF THE INVENTION

The dyes used in the present invention and expressed by the general formula (I) may easily be prepared in a known manner, for instance, by acylating the imino group of a compound expressed by the following general formula (a) with a carboxylic anhydride, followed by nucleophilic substitution with an aniline derivative expressed in terms of the following general formula (b):

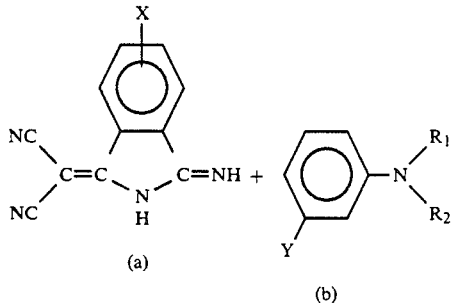

wherein $R_1$, $R_2$, X and Y have the same meanings as defined above.

Illustrative examples of preferable substituents in the general formula (I) will be tabulated in Table 1 to be given later. It is noted that $R_1$ and $R_2$ may form a five- or six-membered ring which may include an oxygen or nitrogen atom.

The dyes preferably used in the present invention have a molecular weight of at least 300.

Illustrative examples of the dyes preferably used in the present invention will be enumerated in Table 1, given below, in which the substituents $R_1$, $R_2$, X and Y in the general formula (I) as well as their molecular weight are shown.

TABLE 1

| No. | $R_1$ | $R_2$ | Y | X | Mwt |
|---|---|---|---|---|---|
| 1 | $-CH_3$ | $-CH_3$ | $-H$ | $-H$ | 298.2 |
| 2 | $-C_2H_5$ | $-C_2H_5$ | $-NHCOCH_3$ | $-H$ | 383.2 |
| 3 | $-C_4H_9$ | $-C_4H_9$ | $-H$ | $-H$ | 382.3 |
| 4 | $-C_2H_5$ | $-C_2H_5$ | $-NHCOC_2H_5$ | $-H$ | 397.3 |
| 5 | $-C_2H_5$ | $-C_2H_5$ | $-NHCOC_4H_9$ | $-H$ | 425.3 |
| 6 | $-C_2H_5$ | $-C_2H_4OH$ | $-NHCOC_2H_5$ | $-H$ | 413.3 |
| 7 | $-C_2H_5$ | $-C_2H_5$ | $-NHCOC_2H_5$ | $-Cl$ | 431.7 |
| 8 | $-C_2H_5$ | $-C_2H_5$ | $-OCOCH_3$ | $-H$ | 384.3 |
| 9 | $-C_2H_5$ | $-C_2H_5$ | $-OCOC_2H_5$ | $-CN$ | 423.3 |

TABLE 1-continued

| No. | $R_1$ | $R_2$ | Y | X | Mwt |
|---|---|---|---|---|---|
| 10 | $-CH_3$ | $-CH_3$ | $-OCOC_4H_9$ | $-H$ | 398.3 |
| 11 | $-C_2H_5$ | $-C_2H_4OH$ | $-OCOC_2H_5$ | $-Cl$ | 448.7 |
| 12 | $-C_2H_5$ | $-C_2H_5$ | $-NHSO_2CH_3$ | $-H$ | 419.3 |
| 13 | $-CH_3$ | $-CH_3$ | $-NHSO_2C_4H_9$ | $-H$ | 433.3 |
| 14 | $-C_3H_7$ | $-C_3H_7$ | $-NHSO_2C_3H_7$ | $-Cl$ | 509.8 |
| 15 | $-C_2H_5$ | $-C_2H_5$ | $-NHCOC_2H_5$ | $-Br$ | 476.2 |
| 16 | $-C_2H_5$ | $-C_2H_5$ | $-NHCOC_2H_5$ | $-CN$ | 422.3 |

The dyes of the general formula (II) used according to the second aspect of the present invention may readily be prepared in a known manner, for instance, by the oxidative coupling of a benzothiophene derivative expressed by the following general formula (a) with a p-phenylenediamine derivative having the following general formula (b) or the condensation-with-dehydration of the benzothiophene derivative of the general formula (a) with a nitroso compound expressed in terms of the following general formula (c).

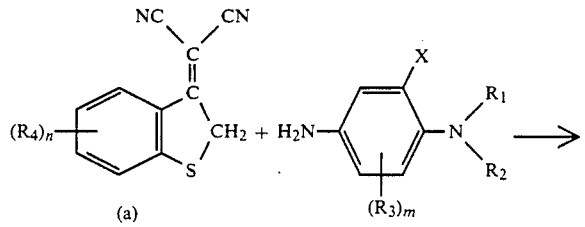

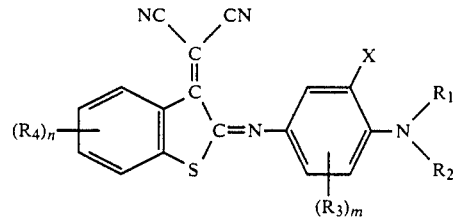

(II)

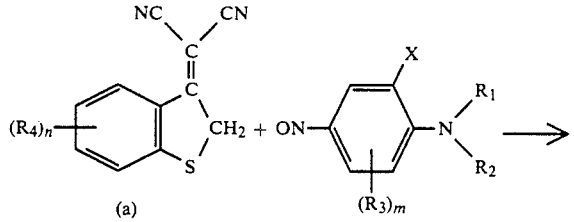

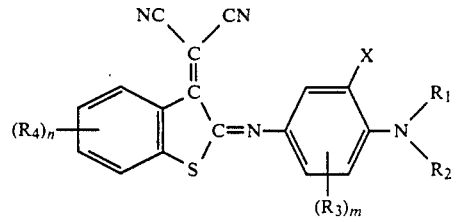

(II)

wherein $R_1$-$R_4$, X, m and n have the same meanings as defined above.

The benzothiophene derivative of the general formula (a) may easily be prepared by the reaction of malononitrile with benzothiophene-3-one readily synthesized by the method set forth in, e.g., J. CHEM. SOC. PERKIN TRANS. I 385–390 (1984).

Referring more illustratively to examples of preferred substituents in the general formula (II), the substituent $R_1$ includes an alkyl group such as methyl, ethyl, propyl and butyl groups; an alkoxyalkyl group such as methoxyethyl and ethoxylethyl groups; a hydroxyalkyl group such as hydroxyethyl and β-hydroxypropyl groups; a halogenoalkyl group such as a chloroalkyl group; a cyanoalkyl group such as cyanomethyl and cyanoethyl groups; a cycloalkyl group such as a cyclohexane group; an aralkyl group such as benzyl and phenetyl groups; an aryl group such as phenyl, tolyl, halogenophenyl and alkoxylphenyl groups; or an atom which forms a five- or six-membered ring with X.

The substituent $R_2$ embraces an alkyl group such as methyl, ethyl, propyl and butyl groups; an alkoxyalkyl group such as methoxyethyl and ethoxylethyl groups; a hydroxyalkyl group such as hydroxyethyl and β-hydroxyalkyl groups; a halogenoalkyl group such as a chloroethyl group; a cyanoalkyl group such as cyanomethyl and cyanoethyl groups; a cycloalkyl group such as a cyclohexane group; an aralkyl group such as benzyl and phenetyl groups; and an aryl group such as phenyl, tolyl, halogenophenyl and alkoxylphenyl groups.

It is understood that the substituents $_1$ and $R_2$ may form together a five- or six-membered ring which may contain an oxygen or nitrogen atom.

The substituents $R_3$ and $R_4$ include a hydrogen atom; a halogen atom such as fluorine, chlorine, bromine and iodine; a cyano group; a nitro group; an alkyl group such as methyl, ethyl, propyl and butyl groups; an alkoxylalkyl group such as methoxyethyl and ethoxylethyl groups; a hydroxyalkyl group such as hydroxyethyl and β-hydroxypropyl groups; a halogenoalkyl group such as a chloroethyl group; a cyanoalkyl group such as cyanomethyl and cyanoethyl groups; cycloalkyl group such as a cyclohexane group; an alkoxy group such as methoxy, propoxy and butoxy; an aryl group such as phenyl, tolyl, halogenophenyl and alkoxyphenyl groups; an aralkyl group such as benzyl and phenetyl groups; an acylamino group such as acetylamino and benzoylamino groups; a sulfonylamino group such as methanesulfonylamino, ethanesulfonylamino and benzenesulfonylamino groups; an ureido group such as methylureido, 1,3-methylureido and ethylureido groups; a carbamoyl group such as methylcarbamoyl, ethylcarbamoyl and phenylcarbamoyl groups; a sulfamoyl group such as methylsulfamoyl, ethylsulfamoyl and phenylsulfamoyl groups; an acyl group such as acetyl, propanoyl and benzoyl groups; and an amino group such as methylamino, ethylamino, propylamino, dimethylamino and diethylamino groups.

The substituent X denotes a hydrogen atom, or an atom or atomic group which forms a five- or six-membered ring with $R_1$, and m and n each indicate 1 or 2.

The dyes according to the second aspect of the present invention should preferably have a molecular weight of 400 or more.

Illustrative dyes preferably used according to the second aspect of the present invention will now be summarized in Table 2 showing illustrative examples of the substituents $R_1$–$R_4$, X, m and n as well as their molecular weight.

TABLE 2

| No. | $R_1$ | $R_2$ | $R_3$ | m | $R_4$ | n | X | Molecular weight |
|---|---|---|---|---|---|---|---|---|
| 1 | $-C_2H_5$ | $-C_2H_5$ | 1-$OC_2H_5$ | 1 | —H | 1 | H | 400.0 |
| 2 | $-C_2H_5$ | $-C_2H_4OH$ | 1-$CH_3$ | 1 | —H | 1 | H | 386.0 |
| 3 | $-C_2H_5$ | $-C_2H_5$ | 1,3-$OC_2H_5$ | 2 | —H | 1 | H | 444.0 |
| 4 | $-CH_3$ | —Ph | 1-Cl | 1 | 7-$NO_2$ | 1 | H | 469.5 |
| 5 | $-C_2H_5$ | $-C_2H_4Cl$ | 1-$CH_3$ | 1 | 7$NHCOCH_3$ | 1 | H | 461.5 |
| 6 | $-CHCH_3CH_2C(CH_3)_2$-*1 | $-C_2H_5$ | 1-$C_4H_9$ | 1 | 7-NBr | 1 | — | 546.9 |
| 7 | $-C_8H_{17}$ | $-C_6H_{13}$ | 1-$NHSO_2CH_3$ | 1 | —H | 1 | H | 589.0 |
| 8 | $-C_2H_4NHSO_2CH_3$ | $-C_2H_5$ | 1-$CH_3$ | 1 | 7-$OC_2H_5$ | 1 | H | 507.0 |
| 9 | $-C_2H_5$ | $-C_2H_4OH$ | 1-$OC_2H_5$ | 1 | —H | 1 | H | 416.0 |
| 10 | $-C_2H_5$ | $-C_2H_5$ | 1,3-$CH_3$ | 2 | 7-CN | | H | 409.0 |
| 11 | $-C_2H_5$ | $-CH_2Ph$ | —H | 1 | 7-$CH_3$ | 1 | H | 432.0 |
| 12 | $-C_2H_5$ | $-C_2H_4CN$ | 1-$NHSO_2CH_3$ | 1 | 7-Cl | 1 | H | 508.5 |
| 13 | $-C_2H_5$ | $-C_2H_5$ | 1,3-$CH_3$ | 2 | —H | 1 | H | 384.5 |
| 14 | $-C_2H_5$ | $-C_2H_5$ | 1-$NHCOC_2H_5$ | 1 | —H | 1 | H | 427.0 |
| 15 | $-C_2H_5$ | $-C_2H_5$ | 1-Br | 1 | —H | 1 | H | 434.9 |
| 16 | $-C_2H_5$ | $-C_2H_5$ | 1-$SO_2C_2H_5$ | 1 | —H | 1 | H | 448.0 |
| 17 | $-C_2H_5$ | $-C_2H_5$ | 1-$NHC_4H_9$ | 1 | —H | 1 | H | 427.0 |
| 18 | $-C_2H_5$ | $-C_2H_5$ | 1-$NHCONHC_2H_5$ | 1 | —H | 1 | H | 442.0 |
| 19 | $-CH_3$ | $-C_2H_5$ | 1-$CONHC_4H_9$ | 1 | —H | 1 | H | 455.0 |
| 20 | $-C_2H_5$ | $-C_2H_4OH$ | 1-$SO_2NHC_2H_5$ | 1 | —H | 1 | H | 479.0 |
| 21 | $-C_2H_5$ | $-C_2H_5$ | 1-$COC_2H_5$ | 1 | —H | 1 | H | 412.0 |
| 22 | $-C_2H_5$ | $-C_2H_5$ | 1-$CH_3$ | 1 | 7-$SO_2C_2H_5$ | 1 | H | 462.0 |
| 23 | $-CH_3$ | $-CH_3$ | 1-$CH_3$ | 1 | 7-$NH_2$ | 1 | H | 357.0 |
| 24 | $-C_2H_5$ | $-C_2H_5$ | 1-$CH_3$ | 1 | 7-$NHCONHC_2H_5$ | 1 | H | 456.0 |
| 25 | $-C_2H_5$ | $-C_2H_5$ | 1-$CH_3$ | 1 | 7-$CONHCH_3$ | 1 | H | 427.0 |
| 26 | $-C_2H_5$ | $-C_2H_5$ | —H | 1 | 7-$SO_2NHC_2H_5$ | 1 | H | 463.0 |
| 27 | $-C_2H_5$ | $-C_2H_5$ | 1-$OC_2H_5$ | 1 | —H | 1 | H | 456.0 |
| 28 | $-C_2H_5$ | $-C_2H_5$ | 1-$NHSO_2CH_3$ | 1 | —H | 1 | H | 449.0 |
| 29 | $-C_2H_5$ | $-C_2H_5$ | 1-$CH_3$ | 1 | 7-$NHSO_2CH_3$ | 1 | H | 463.0 |

*1 $R_1$ and X form together a ring.

The heat transfer sheets according to the present invention are characterized by using such specific dyes as mentioned above, and may be identical in otherwise structure with conventional, known heat transfer sheets.

As the substrate sheet used for the heat transfer sheet containing the above dye according to the present invention, use may be made of any known material having some heat resistance and strength. By way of example alone, use may be made of paper sheets, various processed-paper sheets, polyester films, polystyrene films, polypropylene films, polysulfone films, polycarbonate films, aramide films, polyvinyl alcohol films, cellophane and so on, all having a thickness of about 0.5 to 50 μm, preferably about 3 to 10 μm. Particular preference is given to polyester films.

The dye carrying layers formed on the surfaces of such substrate sheets as mentioned above may be obtained by carrying the dyes of the general formula (I) or (II) thereon with any suitable binder resin.

As the binder resins to carry the above dye, use may be made of any known available resins. Preferable to this end are cellulosic resins such as ethyl cellulose, hydroxyethyl cellulose, ethylhydroxy cellulose, hydroxypropyl cellulose, methyl cellulose, cellulose acetate and cellulose acetate butyrate; and vinylic resins such as polyvinyl alcohol, polyvinyl acetate, polyvinyl butyral, polyvinyl acetal, polyvinyl pyrrolidone and polyacrylic amide. Of these resins, particular preference is given to polyvinyl butyral and polyvinyl acetal in view of heat resistance and dye-transfer properties.

The dye carrying layers of the heat transfer sheets according to the present invention are basically formed of the above materials and, if required, may include various additives such as those heretofore known in the art.

Preferably, such a dye carrying layer may be formed on the above substrate sheet by dissolving or dispersing the above dye, binder resin and any other components in a suitable solvent to prepare a coating or ink liquid for the formation of the dye carrying layer and, then, coating it on the substrate, followed by drying.

Suitably, the carrying layer formed in this manner has a thickness of about 0.2 to 5.0 μm, preferably about 0.4 to 2.0 μm and a dye content of 5 to 70% by weight, preferably 10 to 60% by weight based on the weight thereof.

The heat transfer sheets of the present invention may be successfully used as such for the purpose of heat transfer. By the provision of an anti-tack layer, i.e., a release coat on the surface of the dye carrying layer, however, it is possible to prevent the heat transfer sheet from sticking to an image-receiving sheet at the time of heat transfer and hence use much more increased heat transfer temperatures, thereby forming an image of much more improved density.

Some anti-tack effects may be obtained by using only anti-tack inorganic powders for that release layer. However, more preferable results are obtained by forming a release layer of 0.01 to 5 μm, preferably 0.05 to 2 μm in thickness from a resin having excellent releasability such as silicone polymers, acrylic polymers and fluorinated polymers.

It is understood that such inorganic powders or releasable polymers as mentioned above produce sufficient release effects, even if they are contained in the dye-carrying layer.

Furthermore, such a heat transfer sheet may additionally be provided on its back side with a heat-resistant layer so as to prevent the heat of a thermal head from having an adverse influence thereon.

The image-receiving sheet used for forming an image with such a heat transfer sheet as mentioned above may be any material having its recording surface capable of receiving the above dye. In the case of paper, metal, glass, synthetic resin or the like having the property of being incapable of receiving the dye, they may be provided on one of their major surfaces with a dye-receiving layer.

As the image-receiving materials which may not contain any dye-receiving layer, use may be made of fibers, woven fabrics, films, sheets and fromings formed of, for instance, polyolefinic resins such as polypropylene, halogenated polymers such as polyvinyl chloride and polyvinylidene chloride, vinylic polymers such as polyvinyl acetate and polyacrylic esters, polyester resins such as polyethylene terephthalate and polybutylene terephthalate, polystyrene resins, polyamide resins, copolymeric resins of olefins such as ethylene and propylene with other vinylic monomers, ionomers, cellulosic resins such as cellulose diacetate and polycarbonate.

Particular preference is given to polyester sheets or films or processed paper having a polyester layer. Non-dyeable, image-receiving materials such as paper. metal and glass may be formed into image-receiving materials by coating a solution or dispersion of such a dyeable resin as mentioned above on their recording surfaces, followed by drying, or laminating a film of such resins thereon.

As is the case with the above paper, such a dyeable, image-receiving material may additionally be formed on its surface with a dye receiving layer of a resin of much more improved dyeability.

The dye receiving layer prepared in this manner may be formed of a single material or a plurality of materials. As a matter of course, it may contain various additives, provided that the desired object is achievable.

Such a dye receiving layer may have any suitable thickness but may generally be 3 to 50 μm in thickness. Although the dye receiving layer should preferably be provided in the form of a continuous coating, it may be provided in the form of a discontinuous coating by using a resin emulsion or dispersion.

The image-receiving material is basically as mentioned above and may successfully be used as such. However, this image-receiving material or its dye receiving layer may contain inorganic powders for anti-tack purposes. In this way, an improved heat transfer is achievable since the heat transfer sheet is prevented from sticking to the image-receiving material even at elevated heat transfer temperatures. By far the most preference is given to finely divided silica.

In place of or in combination with such inorganic powders as the above silica, such resins of improved releasability as already indicated may be added. By far the most preference is given to cured silicone compounds, typically, cured products comprising epoxy modified silicone oil and amino modified silicone oil. Such a release agent may preferably account for about 0.5 to 30% by weight of the dye receiving layer.

In addition, the image-receiving material used may be either deposited on the surface of its dye receiving layer with such inorganic powders as already indicated so as to improve its anti-tack effect or provided thereon with a layer consisting of such a release agent of improved releasability as already indicated.

At a thickness of about 0.01 to 5 μm, such a release layer produces an effect so sufficient that many more improvements can be introduced in dye acceptability, while preventing any sticking of the dye receiving layer of the heat transfer sheet to the image-receiving layer.

As the thermal energy applying means used for carrying out heat transfer printing using such a heat transfer sheet of the present invention as already indicated, and such an image-receiving material as already stated, any of the conventional means hitherto known in the art may be used. For instance, the desired object is successfully achievable by the application of a heat energy of about 5 to 100 mJ/mm$^2$ for a controlled recording time with such recording hardware as a thermal printer (e.g., Video Printer VY-100 made by Hitachi Co., Ltd.).

According to the present invention as detailed above, although the dye used for the heat transfer sheet of the present invention is much higher in molecular weight than the sublimable dyes used for conventional heat transfer sheets (having a molecular weight of about 150 to 250), it shows improved thermal transferability and excellent dyeability and color developability with respect to the image-receiving material due to its specific structure and its having a substituent at a specific position. Moreover, it is unlikely to transfer or bleed through, the heat transfer sheet after transferring.

Although formed of dyes, the obtained images are unlikely to suffer from serious discoloration/fading drawbacks which are caused by exposure to indoor light, or even when they are placed in albums or cases or form parts of books.

Thus, the image formed with the heat transfer sheet of the present invention is so high in its fastness properties, inter alia, its resistance to both transfer and contamination, and so improved in its resistance to discoloration/fading that it cannot possibly be blurred or contaminate other articles, thus making it possible to solve various problems of the prior art.

The present invention will now be explained more illustratively with reference to the following reference examples, examples and comparative examples. It is understood that unless otherwise stated, "parts" and "%" are given on a weight basis.

Reference Example A1

(a)

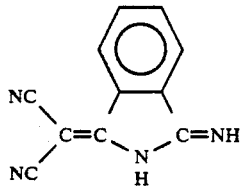

Ten (10.0) parts of the above compound (a) and 6.0 parts of N,N-dimethylaniline were heated to 120° C. for 1.5 hours in 150 parts of acetic anhydride in the presence of some droplets of concentrated sulfuric acid.

After cooling, the obtained precipitates were subjected to suction filtration, washed with acetic anhydride and methanol, and dried to obtain 5.4 parts of a dye shown at No. 1 in Table 1.

Reference Example A2

Ten (10.0) parts of the above compound (a) and 15.0 parts of N,N-dimethyl-m-aminoacetanilide were heated to 120° C. for 1.5 hours in 90 parts of propionic anhydride in the presence of some droplets of concentrated sulfuric acid.

After cooling, the obtained precipitates were subjected to suction filtration, washed with propionic anhydride and methanol, and dried to obtain 6.2 parts of a dye shown at No. 2 in Table 1.

Reference Examples A3 to A16

With the starting materials corresponding to dyes shown at Nos. 3 to 16 in Table 1, dyes Nos. 3 to 16 were obtained in similar manners as in Reference Example A1 or A2.

EXAMPLE A

Prepared was an ink composition for the formation of a dye carrying layer, composed of the following ingredients, and which was then coated on a 6 μm thick polyethylene terephthalate film subjected to heat-resistant treatment on its back side in a quantity of 1.0 g/m$^2$ on a dry basis. Subsequent drying gave the heat transfer sheets according to the present invention.

| | |
|---|---|
| Dyes shown in Table 1 | 3 parts |
| Polyvinyl butyral resin | 4.5 parts |
| Methyl ethyl ketone | 46.25 parts |
| Toluene | 46.25 parts |

It is noted, however, that when the dyes were insoluble in the above composition, DMF, dioxane, chloroform, etc. were optionally used as the solvents.

Next, a coating solution composed of the following ingredients was coated on one side of a substrate sheet formed of a synthetic paper (Yupo FPG #150 made by Oji Yuka Co., Ltd.) in an amount of 10.0 g/m$^2$ on a dry basis, which was then dried at 100° C. for 30 minutes to obtain an image-receiving material.

| | |
|---|---|
| Polyester resin (Vylon 200 made by Toyobo Co., Ltd.) | 11.5 parts |
| Vinyl chloride/vinyl acetate copolymer (VYHH made by UCC) | 5.0 parts |
| Amino modified silicone (KF-393 made by Shin-Etsu Chemical Co., Ltd.) | 1.2 parts |
| Epoxy modified silicone (X-22-343 made by Shin-Etsu Chemical Co., Ltd.) | 1.2 parts |
| Methyl ethyl ketone/toluene/cyclohexanone (4:4:2 in weight ratio) | 102.0 parts |

Each of the above heat transfer sheets according to the present invention was overlaid on the above image-receiving material with the dye-carrying and -receiving layers located in opposition to each other. Then, recording was carried out from the back side of the heat transfer sheet with a thermal head under the following conditions: at a voltage of 10V applied to the head for a printing time of 4.0 msec. The results are summarized in Table 3.

TABLE 3

| Dyes | Density of Developed Color | Storability | Tint |
|---|---|---|---|
| 1 | 2.45 | ○ | Blue |
| 2 | 1.95 | ● | Blue |
| 3 | 1.89 | ● | Blue |
| 4 | 1.76 | ● | Blue |
| 5 | 1.69 | ● | Blue |
| 6 | 1.51 | ● | Blue |
| 7 | 1.57 | ● | Blue |
| 8 | 1.83 | ● | Blue |
| 9 | 1.64 | ● | Blue |
| 10 | 1.84 | ● | Blue |
| 11 | 1.30 | ● | Blue |
| 12 | 1.50 | ● | Blue |
| 13 | 1.46 | ● | Blue |
| 14 | 1.00 | ● | Blue |
| 15 | 1.36 | ● | Blue |
| 16 | 1.69 | ● | Blue |

COMPARATIVE EXAMPLES A1 TO A5

Example A1 was repeated, provided however that the dyes specified in the following Table 4 were used in place of the dyes used therein. The results are shown in Table 4.

TABLE 4

| Comp. Ex. | Density of Developed Color | Storability |
|---|---|---|
| A1 | 0.99 | X |
| A2 | 1.16 | Δ |
| A3 | 2.07 | X |
| A4 | 1.12 | Δ |
| A5 | 1.02 | X |

Comp. Ex. A1 = C.I. disperse blue 14
A2 = C.I. disperse blue 134
A3 = C.I. disperse blue 63
A4 = C.I. disperse blue 26
A5 = C.I. disperse violet 4

It is noted that the density of developed colors as referred to above was measured with Densitometer RD-918 made by Macbeth Co. Ltd., U.S.A.

Storability was measured after the recorded images had been allowed to stand in an atmosphere of 70° C. for 48 hours, and was estimated as follows.

Double circles indicate that the sharpness of the images underwent no change at all and that when they were rubbed with white paper, it was not colored at all; circles indicate that the image lost sharpness with slight coloration of white paper; triangles indicate that the images lost sharpness with white paper being colored; and crosses indicate that the image became blurred with a noticeable coloration of white paper.

Reference Example B1

One (1) part of benzo[b]thiophen-3(2H)-one and 0.5 parts of malononitrile were dissolved in ethanol, and 0.8 parts of diazobicycloundecene was added dropwise to the solution for 10-hour reaction at room temperature. After the completion of the reaction, ethyl acetate and water were added to the reaction product to separate it into phases, the organic phase of which was concentrated to solid, thereby obtaining 0.7 parts of 3-dicyanoethylidenebenzo[b]thiophene (in a yield of 54%).

Dissolved in ethyl acetate were 0.7 parts of this 3-dicyanoethylidenebenzo[b]thiophene, and added to the resulting solution was an aqueous solution of silver chloride prepared beforehand with 24 parts of silver chloride, 4.3 parts of sodium chloride and 70 parts of water. Furthermore, 4.5 parts of aqueous ammonia and 4 parts of 2-amino-5-diethylaminoethoxybenzene chloride were added for 1-hour reaction at room temperature. After the reaction had been completed, an organic phase was separated, water-washed and concentrated to a solid, which was in turn refined by column chromatography to obtain 1.0 part of a dye having the following structural formula (shown at No. 1 in Table 1) in a 75% yield. The maximum absorption wavelength (ethyl acetate) was found at 668 nm.

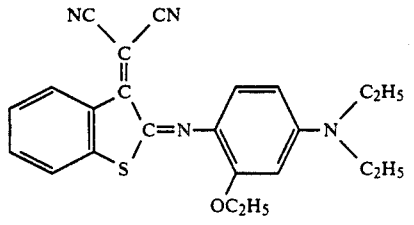

Reference Examples B2 to B29

With the starting materials corresponding to dyes shown at Nos. 2 to 29 in Table 2, dye Nos. 2 to 29 were obtained in a similar manner as in Reference Example B1.

EXAMPLE B

Prepared was an ink composition for the formation of a dye carrying layer, composed of the following ingredients, which was then coated on a 6 μm thick polyethylene terephthalate film subjected to heat-resistant treatment on its back side in a quantity of 1.0 g/m² on dry basis. Subsequent drying gave the heat transfer sheets according to the present invention.

| | |
|---|---|
| Dyes shown in Table 2 | 3 parts |
| Polyvinyl butyral resin | 4.5 parts |
| Methyl ethyl ketone | 46.25 parts |
| Toluene | 46.25 parts |

It is noted, however, that when the dyes were insoluble in the above composition, DMF, dioxane, chloroform, etc. were optionally used as the solvents.

Next, a coating solution composed of the following ingredients were coated on one side of a substrate sheet formed of a synthetic paper (Yupo FPG #150 made by Oji Yuka Co., Ltd.) in an amount of 10.0 g/m² on dry basis, which was then dried at 100° C. for 30 minutes to obtain an image-receiving material.

| | |
|---|---|
| Polyester resin (Vylon 200 made by Toyobo Co., Ltd.) | 11.5 parts |
| Vinyl chloride/vinyl acetate copolymer (VYHH made by UCC) | 5.0 parts |
| Amino modified silicone (KF-393 made by the Shin-Etsu Chemical Co., Ltd.) | 1.2 parts |
| Epoxy modified silicone (X-22-343 made by the Shin-Etsu Chemical Co., Ltd.) | 1.2 parts |
| Methyl ethyl ketone/toluene/cyclohexanone (4:4:2 in weight ratio) | 102.0 parts |

Each of the above heat transfer sheets according to the present invention was overlaid on the above image-receiving material with the dye-carrying and -receiving layers located in opposition to each other. Then, recording was carried out from the back side of the heat transfer sheet with a thermal head under the following conditions: at a voltage of 10 V applied to the head for a printing time of 4.0 msec. The results are summarized in Table 5.

TABLE 5

| Dyes | Density of Developed Color | Storability | Tint |
|---|---|---|---|
| 1 | 1.93 | ◎ | Indigo |
| 2 | 1.75 | ◎ | Indigo |
| 3 | 2.07 | ◎ | Indigo |
| 4 | 1.94 | ◎ | Indigo |
| 5 | 2.21 | ◎ | Indigo |
| 6 | 2.27 | ◎ | Indigo |
| 7 | 2.43 | ◎ | Indigo |
| 8 | 2.03 | ◎ | Indigo |
| 9 | 1.88 | ◎ | Indigo |
| 10 | 2.02 | ◎ | Indigo |
| 11 | 2.06 | ◎ | Indigo |
| 12 | 2.19 | ◎ | Indigo |
| 13 | 2.06 | ◎ | Indigo |
| 14 | 2.05 | ◎ | Indigo |
| 15 | 2.07 | ◎ | Indigo |
| 16 | 2.03 | ◎ | Indigo |
| 17 | 2.04 | ◎ | Indigo |
| 18 | 2.10 | ◎ | Indigo |
| 19 | 2.16 | ◎ | Indigo |
| 20 | 2.02 | ◎ | Indigo |
| 21 | 2.01 | ◎ | Indigo |
| 22 | 2.12 | ◎ | Indigo |

TABLE 5-continued

| Dyes | Density of Developed Color | Storability | Tint |
|---|---|---|---|
| 23 | 1.92 | ◉ | Indigo |
| 24 | 2.06 | ◉ | Indigo |
| 25 | 1.99 | ◉ | Indigo |
| 26 | 2.20 | ◉ | Indigo |
| 27 | 2.20 | ◉ | Indigo |
| 28 | 1.82 | ◉ | Indigo |
| 29 | 1.97 | ◉ | Indigo |

Comparative Examples B1 to B5

Example B1 was repeated, provided however that the dyes specified in the following Table 6 were used in place of the dyes used therein. The results are shown in Table 6.

TABLE 6

| Comp. Ex. | Density of Developed Color | Storability |
|---|---|---|
| B1 | 0.99 | X |
| B2 | 1.16 | Δ |
| B3 | 2.07 | X |
| B4 | 1.12 | Δ |
| B5 | 1.02 | X |

Comp. Ex. B1 = C.I. disperse blue 14
B2 = C.I. disperse blue 134
B3 = C.I. disperse blue 63
B4 = C.I. disperse blue 26
B5 = C.I. disperse violet 4

It is noted that the density of developed colors as referred to above was measured with Densitometer RD-918 made by Macbeth Co. Ltd., U.S.A.

Storability was measured after the recorded images had been allowed to stand in an atmosphere of 70° C. for 48 hours, and was estimated as follows.

Double circles indicate that the sharpness of the images underwent no change at all and that when they were rubbed with white paper, the paper was not colored at all; circles indicate that the image lost sharpness with a slight coloration of white paper; triangles indicate that the images lost sharpness with white paper being colored; and crosses indicate that the image became blurred with a noticeable coloration of white paper.

What is claimed is:

1. A heat transfer sheet comprising a substrate sheet and a dye-carrying layer formed on the substrate sheet, said dye-carrying layer comprising a binder and a dye expressed by the following general formula (I):

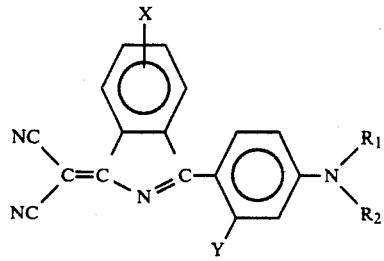

(I)

wherein:

X stands for a hydrogen atom or at least one substituent,

Y indicates a hydrogen atom, a hydroxyl group, an alkyl group, an alkoxy group, —OCOR′, —NHCOR′ or —$NHSO_2R'$ in which R′ stands for an alkyl group or a substituted alkyl group, and $R_1$ and $R_2$ each denote an alkyl group or a substituted alkyl group.

2. A heat transfer sheet as claimed in claim 1, wherein said dye has a molecular weight of about 300 or higher.

3. A heat transfer sheet comprising a substrate sheet and a dye carrying layer formed on the substrate sheet, said dye-carrying layer comprising a binder and a dye expressed by the following general formula (II):

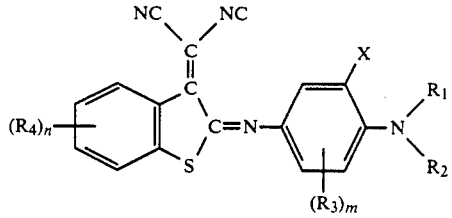

(II)

wherein:

$R_1$ stands for a substituted or unsubstituted alkyl, cycloalkyl, aralkyl or aryl group, or an atom or atomic group which forms a five- or six-membered ring with X, $R_2$ denotes a substituted or unsubstituted alkyl, cycloalkyl, aralkyl or aryl group, said $R_1$ and $R_2$ may form together a five- or six-membered ring which may include an oxygen or nitrogen atom, $R_3$ and $R_4$ each represent a hydrogen atom, a halogen atom, a cyano group or a nitro group, or an alkyl, cycloalkyl, alkoxy, aryl, aralkyl, acylamino, sulfonylamino, ureido, carbamoyl, sulfamoyl, acyl or amino group which may contain a substituent, X stands for a hydrogen atom, or an atom or atomic group which forms a five- or six-membered ring with $R_1$, and m and n each are 1 and 2.

4. A heat transfer sheet as claimed in claim 3, wherein said dye has a molecular weight of about 400 or higher.

* * * * *